US006569296B1

(12) United States Patent
Burgher et al.

(10) Patent No.: US 6,569,296 B1
(45) Date of Patent: May 27, 2003

(54) LADDER ANODE FOR CATHODIC PROTECTION OF STEEL REINFORCEMENT IN ATMOSPHERICALLY EXPOSED CONCRETE

(76) Inventors: John William Burgher, 910-523 Portsmouth Avenue, Kingston, Ontario (CA), K7M 7H6; Dennis F. Dong, 12 Nottingham Place, Kingston, Ontario (CA), K7M 7H1; Richard Eric Loftfield, 1050 Secret Oaks Pl., Fruitcove, FL (US) 32259

( * ) Notice: Subject to any disclaimer, the term of this patent is extended or adjusted under 35 U.S.C. 154(b) by 1301 days.

(21) Appl. No.: 08/593,507

(22) Filed: Jan. 30, 1996

(51) Int. Cl.[7] ..... C23F 13/00

(52) U.S. Cl. ..... 204/196.36; 204/284; 204/292; 205/734

(58) Field of Search ..... 204/284, 290 F, 204/196, 197, 292; 205/734, 738

(56) References Cited

U.S. PATENT DOCUMENTS 3,907,659 A * 9/1975 Paige et al. ..... 204/292
4,506,485 A * 3/1985 Apostolos ..... 204/196
4,855,024 A * 8/1989 Drachnik et al. ..... 204/196
4,997,492 A * 3/1991 Taki ..... 204/293
5,411,646 A * 5/1995 Gossett et al. ..... 205/734
5,569,526 A * 10/1996 Tettamanti et al. ..... 204/196

FOREIGN PATENT DOCUMENTS

GB 896912 * 5/1962 ..... 204/196

* cited by examiner

*Primary Examiner*—T. Tung
(74) *Attorney, Agent, or Firm*—Hudak, Shunk & Farine Co. LPA

(57) ABSTRACT

A grid anode for cathodic protection of steel reinforced concrete structures formed of multiple valve metal strips including multiple electric current-carrying valve metal strips. Valve metal strip grid anodes without an electrocatalytic metal surface can be used in a cathodic protection system operated at an anode current density up to about 20 milliamps per square foot. Composite anodes having an electrocatalytic metal coating are useful at higher anode current densities.

23 Claims, 4 Drawing Sheets

LADDER ANODE FOR CATHODIC PROTECTION OF STEEL REINFORCEMENT IN ATMOSPHERICALLY EXPOSED CONCRETE

BACKGROUND OF THE INVENTION

1. Field of the Invention

This invention is directed to anodes in the form of a grid for use in cathodic protection systems.

2. Description of Related Prior Art

Cathodic protection of metal structures, or of metal containing structures, in order to inhibit or prevent corrosion of the metal in the structure is well known by use of impressed current cathodic protection systems. In such systems, counter electrodes and the metal of the structure are connected to a source of direct current. In operation the metal of the structure, such as a steel reinforcement for a concrete structure, is cathodically polarized. The steel reinforcement becomes cathodically polarized being spaced from the anodically polarized electrode and is inhibited against corrosion. While cathodic protection is well known for metal or metal containing structures such as in the protection of offshore steel drilling platforms, oil wells, fuel pipes submerged beneath the sea, and in the protection of the hulls of ships, a particularly difficult problem is presented by the corrosion of steel reinforcement bars in steel-reinforced concrete structures. Most Portland cement concrete is porous and allows the passage of oxygen and aqueous electrolytes. Salt solutions which remain in the concrete as a consequence of the use of calcium chloride to lower the freezing point of uncured concrete or snow or ice melting salt solutions which penetrate the concrete structure from the environment can cause more rapid corrosion of steel reinforcing elements in the concrete. For example, concrete structures which are exposed to the ocean and concrete structures in bridges, parking garages, and roadways which are exposed to water containing salt used for deicing purposes are weakened rapidly as the steel reinforcing elements corrode. This is because such elements when corroded create local pressure on the surrounding concrete structure which brings about cracking and eventual spalling of the concrete.

Impressed current cathodic protection systems are well known for the protection of reinforced concrete structures such as buildings and in road construction, and, particularly, in the fabrication of supports, pillars, crossbeams, and road decks for bridges. Over the years, increasing amounts of common salt, sodium chloride, have been used during the winter months to prevent ice formation on roads and bridges. The melted snow or ice and sodium chloride in aqueous solution tend to seep into the reinforced concrete structure. In the presence of chloride ion the reinforcing steel rebars are corroded at an accelerated rate such that the resultant corrosion products formed by the oxidation reaction occupy a greater volume than the space occupied by the reinforcing bars prior to oxidation. Eventually an increased local pressure is created which brings about cracking of the concrete and eventual spalling of the concrete covering the reinforcing members so as to expose the reinforcing members directly to the atmosphere. The use of a valve metal without an electrocatalytically active coating thereon as an anode in a cathodic protection system is unexpected in view of the belief among those skilled in the art that a titanium anode or an alloy of titanium possessing properties similar to titanium cannot be used in an electrolytic process as the surface of the titanium would oxidize when anodically polarized and the titanium or alloys thereof would soon cease to function as an anode.

For instance, in U.S. Pat. No. 5,334,293, electrocatalytically coated anodes of titanium or an alloy of titanium are disclosed for use in an electrolytic cell, particularly, for use as an anode in an electrolytic cell in which chlorine is evolved at the anode. The coating utilized usually includes a metal of the platinum group, oxides of metals of the platinum group, or mixtures of one or more metals such as one or more oxides or mixtures or solid solutions of one or more oxides of a platinum group metal and a tin oxide or one or more oxides of a valve metal such as titanium. Similar electrocatalytically coated titanium electrodes are disclosed in U.S. Pat. No. 3,632,498; U.S. Pat. No. 5,354,444; and U.S. Pat. No. 5,324,407.

Known methods of introducing an anode into existing concrete structures may involve insertion of an anode into a slot cut into the concrete. After application of the anode a cap of grout is applied to backfill the slot. Representative anodes for cathodic protection of steel reinforced concrete structures are disclosed in U.S. Pat. No. 5,062,934 to Mussinelli in which a grid electrode comprised of a plurality of valve metal strips having voids are disclosed. Another type of anode strip for cathodic protection of steel reinforced concrete structures is disclosed in Canadian 2,078,616 to Bushman in which mesh anodes are disclosed consisting of an electrocatalytically coated valve metal which is embedded in a reinforced concrete structure so as to function as the anode in a cathodic protection system. In U.S. Pat. No. 5,031,290 a process is disclosed for the production of an open metal mesh having a coating of an electrocatalytically active material formed by fitting a sheet and stretching the coated sheet to expand the sheet and form an open mesh. In U.S. Pat. No. 4,401,530 to Clere, a three dimensional electrode having substantially coplanar, substantially flat portions, and ribbon-like curved portions is disclosed for use as a dimensionally stable anode in the production of chlorine and caustic soda. The ribbon-like portions of the anode are symmetrical and alternate in rows above and below the flat portions of the anode.

In U.S. Pat. No. 3,929,607 to Krause, an anode assembly for an electrolytic cell is disclosed comprising a film-forming metal foraminate structure comprising a plurality of longitudinal members spaced with their longitudinal axis parallel to one another and carrying on at least part of their surface an electrocatalytically active coating. Each longitudinal member comprises a channel blade member constituted by a pair of parallel blades having one or more bridge portions connected to the current lead-in means.

It is known from U.S. Pat. No. 5,334,293 that a titanium anode cannot be used in an electrolytic cell, particularly in an electrolytic cell in which during operation of the cell chlorine is evolved at the anode. Such an anode cannot be used in this electrolytic cell as the surface of the titanium anode would oxidize when anodically polarized and the titanium would soon cease to function as an anode. Coatings comprising ruthenium oxide are disclosed as useful on a titanium substrate to obtain an electrode having a commercially useful lifetime.

Bockris et al. in *Modem Electrochemistry*, volume 2, pages 1315–1321, Plenum Press, explains the transformation of a metal surface from a corroding and unstable surface to a passive and stable surface as being facilitated by increasing the electrical potential in the positive direction on the metal. As the potential is increased, the current initially increases, reaching a maximum value and then starts sharply to decrease to a negligible value. The point at which the current sharply decreases is referred to as passivation and the potential at which this occurs is termed the passivation potential.

In the prior art, electrodes particularly for use in cathodic protection systems require electrocatalytic coatings on valve metals which are subject to passivation in order to overcome the tendency of such metals to passivate and cease to function as electrodes. Such coatings are described in U.S. Pat. No. 3,632,498 as consisting essentially of at least one oxide of a film-forming metal and a nonfilm-forming conductor the two being in a mixed crystal form and covering at least two percent of the active surface of the electrode base metal. Similarly, electrodes made utilizing a valve metal substrate are disclosed as requiring one or more layers of a coating containing platinum as disclosed in U.S. Pat. No. 5,290,415 and U.S. Pat. No. 5,395,500.

An anode useful in a cathodic protection system to protect the reinforcing steel bars in a concrete structure can consist of a porous titanium oxide, $TiO_x$ where "x" is in the range 1.67 to 1.95, as disclosed in European patent application 186 334 or where "x" is in the range 1.55 to 1.95, as disclosed in U.S. Pat. No. 4,422,917. Other porous materials are disclosed in 186 334 as substitutes for the porous titanium oxide such as graphite, porous magnetite, porous high silicon iron or porous sintered zinc, aluminum or magnesium sheet.

In U.S. Pat. No. 4,319,977, an electrode formed of thin sheets of titanium is disclosed as useful in an electrometallurgical cell. In addition to a metal such as titanium, electrodes consisting essentially of tantalum, niobium, or zirconium are disclosed as useful in the British patent no. 951,766 cited in this United States patent. As described in '977, the titanium electrode is utilized as an anode in a method of electrolytically producing manganese dioxide by immersing the electrode in a solution of manganese sulphate and sulfuric acid and electrolytically depositing the manganese dioxide onto the electrode. Periodically, the manganese dioxide is removed from the electrode.

Expanded mesh anode structures having an electrocatalytic surface which are disclosed as useful for cathodic protection of steel reinforced concrete are disclosed in U.S. Pat. No. 5,421,968, U.S. Pat. No. 5,423,961, and U.S. Pat. No. 5,451,307. These mesh anode structures have 500 to 2000 nodes per square meter formed at metal strand intersections in the mesh and can be supplied in roll form. Upon application to a concrete surface in order to present corrosion of steel reinforcing structures therein, the expanded metal mesh is connected to a current distribution member such as by welding.

A grid electrode is disclosed for use in cathodic protection of steel reinforced concrete structures and a method of forming a grid electrode are disclosed, respectively, in U.S. Pat. No. 5,062,934 and U.S. Pat. No. 5,104,502. The metal members forming the grid electrode comprise a plurality of expanded valve metal strips with voids therein, at least 2000 nodes per square meter formed by intersecting strands of expanded metal, and an electrocatalytic surface thereon. The valve metal strips forming the electrode grid are welded together to form the grid. In use, a current distribution member is also connected at intervals to the electrode grid.

SUMMARY OF THE INVENTION

Disclosed are novel valve metal grid electrodes for operation at either high or low current density, particularly, as grid anodes in a cathodic protection system in which iron or steel rods are embedded in a concrete structure or as grid anodes for the cathodic protection of steel pipelines placed in sea water, saline muds, or in the ground. The steel rods or pipelines are protected against corrosion by connecting the novel valve metal grid anodes and the iron or steel pipelines or reinforcing rods in the concrete structure to an electrical circuit and impressing a current sufficient to cause the iron or steel material to act as a cathode in the circuit. The valve metal anode strips which are spaced apart to form the grid electrode can be porous or non-porous, coated with an electrocatalytically active metal or non-coated, and of any shape, for instance, expanded metals, slit and deformed metal strips, rods, tubes, etc.

BRIEF DESCRIPTION OF THE DRAWINGS

FIG. 1 is a plan view of an example of a portion of a unitary, multiplane, porous, metal strip or ribbon showing a plurality of louvers arranged laterally across the metal strip.

FIG. 2 is a side view of the metal strip of FIG. 1.

FIG. 3 is an enlarged side view taken through section 3—3 of FIG. 1.

FIG. 4 is a plan view of yet another example of a portion of a unitary, multi-plane, porous, metal strip showing a series of louver units oriented on a metal strip in a direction parallel to the longitudinal direction of the metal strip and spaced apart from adjacent louver units by a plane which is intermediate between the planes defined by the upper and lower lateral extremities of said louvers.

FIG. 5 is a side view of the anode of FIG. 4.

FIG. 6 is an isometric view of the anode of FIG. 1.

FIG. 7 is an isometric view of the anode of FIG. 4.

FIG. 8 is a plan view of one example of a portion of a unitary, multi-plane, porous, metal ribbon strip showing perforation or slitting of a metal sheet with openings of predetermined size, shape and arrangement and bending the slit strips to form trough and crest nodes.

FIG. 9 is a cross sectional view of the perforated sheet shown in FIG. 13 showing the appearance on bending the perforated sheet so as to raise upper, crest and lower, trough nodes in a direction normal to the plane of the largest dimension of the perforated sheet.

FIG. 10 is a plan view of a second example of a portion of a unitary, multi-plane, porous, metal strip showing a perforated or slit sheet prior to bending the rows between perforated sections so as to form a metal ribbon having a plurality of trough and crest nodes.

FIG. 11 is a cross sectional view of a portion of the metal ribbon subsequent to bending the rows between perforated sections of the ribbon shown in FIG. 10.

FIG. 12 is an isometric view of a portion of the porous, metal ribbon shown in cross section in FIG. 11.

FIG. 13 is an isometric view of a portion of the metal ribbon shown in cross section in FIG. 9.

Figure 2:
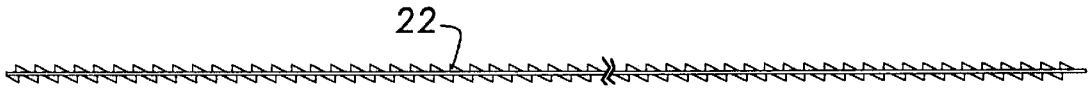
Figure 5:
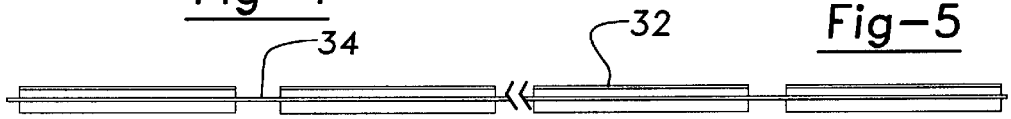

In other embodiments not shown, the louvers of FIGS. 2 and 5 extend only above the base plane of the metal anode strip. In addition to forming the grid electrode of the valve metal strips shown and described above, the valve metal strips can be formed of non-porous valve metal strips or of the expanded valve metals shown in the prior art, for instance in U.S. Pat. No 5,423,961.

DESCRIPTION OF THE PREFERRED EMBODIMENTS

This invention relates, generally, to a cathodically protected concrete structure, a method of forming a grid electrode cathodic protection system, and to a grid electrode for use in a cathodic protection system, particularly for a cathodic protection system to protect a steel reinforced concrete structure. The grid electrode of the invention is formed of a plurality of porous or non-porous valve metal strips forming nodes at the intersections of said strips and electrically connected to form a grid such as by welding.

Porous or non-porous electric current-carrying valve metal members are also spaced apart on the grid electrode and extend across at least two valve metal strips. The current-carrying valve metal members can extend on the grid electrode either laterally or longitudinally and can be coated with an electrocatalytic metal or be uncoated and can be porous or non-porous. If the current-carrying member is placed laterally and electrically connected on the grid electrode, it need not be coated but it may be coated.

Non-porous valve metal strips can be used to form the grid electrode by using valve metal strips either with or without an electrocatalytically active metal surface. Non-porous valve metal strips suitably have a thickness of about 0.010 inches to about 0.030 inches, preferably, about 0.015 inches to about 0.020 inches, and most preferably, about 0.012 inches to about 0.017 inches. Non-porous valve metal strips suitably have a width, generally, of about 0.20 to about 0.25 inches or more.

The porous valve metal strips used to form the grid-electrode of the invention can be formed by slitting and expanding a valve metal ribbon or strip either in a direction normal to the largest surface or in a direction of the plane of the largest surface of a valve metal strip. In addition, the valve metal grid electrodes can function effectively as anodes in a cathodic protection system, for instance, to protect steel reinforcement elements in a concrete structure whether or not the surface of said valve metal has an electrocatalytically active metal coating. The grid electrodes of the invention can be manufactured in roll form for ease of handling. Contrary to prior art grid electrodes, especially of the type in which a valve metal is highly expanded to form a grid sheet of expanded metal, the grid electrodes of the invention can be installed without excessive damage to the grid structure by breakage of the strands of the expanded metal or splitting of the expanded metal at the expanded metal nodes.

The porous valve metal strips suitably have a longitudinal strip thickness, generally, of about 0.015 to about 0.030 inches, preferably, about 0.02 to about 0.025 inches and a width, generally, of about 0.15 to about 0.30 inches, preferably, about 0.20 to about 0.25 inches. Laterally oriented porous valve metal strips, generally, have the same thickness but a preferred thickness of about 0.0175 to about 0.020 inches and the same width as the non-porous strips. Alternatively, where a higher current density is required on the grid anode of the invention either or both longitudinal and lateral strip widths can be, generally, about 0.2 to about 1.5 inches, preferably, about 0.75 to about 1.0 inches and, most preferably, about 0.5 to about 1.0 inches.

In one embodiment, a grid electrode is formed from a plurality of expanded valve metal stripe which are obtained by slitting a valve metal strip, for instance, a grade 2 titanium strip and, subsequently expanding the slit strip in a direction normal to the largest dimension surface of the valve metal strip. A titanium strip thus formed is considerably stronger, as indicated by higher tensile strength and hardness levels, than a strip expanded in the direction of the plane of the largest surface of a grade 1 titanium which is typically used in the prior art to provide an expanded titanium grid electrode structure. The grid electrode of this embodiment of the invention will have a network of nodes having less than about 100 nodes per square meter.

In another embodiment, a valve metal grid electrode can be formed from strips of an expanded valve metal, which are expanded in a direction of the plane of the largest surface, electrically connected at intersecting strips, and expanded at a typical expansion factor of 10:1 and preferably 15:1. A substantially diamond shaped pattern is preferred having about 500 to about 2000 connections per square meter of expanded valve metal strip. These expanded valve metals are disclosed in U.S. Pat. No. 5,062,934; U.S. Pat. No. 5,104,502; U.S. Pat. No. 5,451,307; U.S. Pat. No. 5,423,961; and U.S. Pat. No. 5,421,968 each incorporated by reference herein. The grid electrode of this embodiment of the invention will have a network of nodes formed at the intersections of said strips having less than about 100 nodes per square meter. In both embodiments, the grid electrode is formed by electrically connecting the strips of the grid at the intersections of the valve metal strips.

The grid electrode contains a plurality of electric current-carrying valve metal members spaced apart from one another and, preferably, extending laterally across at least two valve metal strips which extend in a longitudinal direction. Generally, the current-carrying valve metal strips can extend either longitudinally or laterally or both longitudinally and laterally. The valve metal current-carrying strips when oriented longitudinally on the grid electrode can be used to form the grid electrode of the invention with or without an electrocatalytically active metal surface.

Certain of the porous valve metal strips used to form the grid electrode of the invention are disclosed in copending commonly assigned U.S. patent application Ser. No. 08/502,249, filed Jul. 13, 1995, incorporated herein by reference. In all of the embodiments of the valve metal grid electrode of the invention discussed above, the valve metal grid anodes without an electrocatalytic surface are for use in electrochemical systems such as cathodic protection systems which can be operated at low current density in accordance with the teachings of copending, commonly assigned U.S. patent application Ser. No. 08/502,248, filed Jul. 13, 1995 and incorporated herein by reference. Accordingly, each of the valve metal grid electrodes of the embodiments set forth above can utilize a valve metal anode without benefit of an electrocatalytic metal coating thereon.

The valve metal strips can be coated with an electrocatalytic metal coating either before or after forming into an electrode grid. The grid electrodes of the invention are capable of being rolled up subsequent to manufacture to allow ease of transport to a construction site where they are thereafter unrolled and applied to the surface of a concrete structure. In those embodiments in which the grid is formed by the assembly of valve metal strips which have been previously slit and expanded in a direction normal to the largest surface area of the strip, the strength and electrical conductivity of the original valve metal strip before slitting and expansion is retained. In use, a valve metal current distributing member is placed at intervals in association with the grid electrode or a series of adjacent grid electrodes placed on a concrete surface in a cathodic protection system. The valve metal current-distributing member can be porous or non-porous and have an electrocatalytically active metal composite coating or can be uncoated. A series of adjacent grid electrodes on a concrete surface, generally, will be electrically connected by a current distributing member. The current distributing member can be placed laterally at intervals across at least two valve metal strips or can be longitudinally oriented on the grid electrode.

The number of valve metal strips forming the grid electrode which are placed in a longitudinal direction in the grid electrode, generally, is about 1 to about 4, preferably, about 2 to about 3. At least one of the longitudinally directed valve metal strips can be a current distributing member. The grid electrodes can be formed in any suitable width, preferably, about 8 inches to about 30 inches. The void space between lateral valve metal strips in the grid electrode, generally, can be less than 1 inch up to about 6 inches or more, preferably, about 2 inches to about 4 inches, most preferably, about 3 inches to about 4 inches. The spacing between adjacent grid electrodes placed on a concrete surface, generally, is a function of the amount of current required to cathodically protect the steel reinforcement member in the concrete. For even current distribution, this spacing can be from less than 1 inch to about 8 inches, preferably, about 3 inches to about 6 inches, most preferably, about 3 inches to about 4 inches.

In each of the embodiments of the grid electrode of the invention in which the valve metal strip is elongated or expanded in a direction normal to the largest surface area of the strip, the valve metal strips forming the grid electrode of the invention can be formed of a valve metal such as titanium using either a grade 1 or grade 2 titanium. In the prior art, the use of grade 1 titanium has been considered desirable to form an expanded metal structure which is expanded in a direction of the plane of the largest surface of the metal strip because of the, generally, greater expansion ratios utilized to reduce cost and to allow the expansion process to be performed without excessive breakage of the strands of the expanded mesh. Grade 1 titanium is more suitable for preparing such expanded metals as having a lower tensile strength as well as a higher purity than grade 2 titanium. However, the higher cost and reduced availability of grade 1 titanium has necessitated high expansion ratios in order to provide an economical but necessarily weaker expanded mesh structure than can be provided by the use of a grade 2 titanium which is less expensive and more readily available.

I

The grid anode of one embodiment of the invention is formed of a valve metal such as titanium or tantalum having an oxide film on the surface thereof and is formed of porous or non-porous valve metal strips forming nodes at the intersections of said strips and electrically connected and is free of electrocatalytically active metal coatings which have been applied in the prior art to valve metal electrodes, particularly valve metal substrates for use as anodes in cathodic protection systems. The anode grid in this embodiment of the invention does not require the application of an electrocatalytic metal coating or a precursor electrocatalytically active metal coating and the subsequent activation of said catalytic coating.

Surprisingly, it has been found possible to extend the lifetime of a valve metal anode grid, as determined by exposure of the anode grid to accelerated testing, by heating the valve metal anode grid at elevated temperature. Generally, exposure of the valve metal of the anode grid to a temperature of about 250° C. to about 750° C. for a period, generally, of about 3 minutes to about 5 hours, preferably, about 30 minutes to about 3 hours, and most preferably, about 1 hour to about 2 hours results in a substantial improvement in anode grid lifetime, i.e., time before passivation occurs at a given current density. In use, the grid anode in this embodiment of the invention is connected to a source of direct current and the circuit is completed by connecting as a cathode the reinforcing elements, i.e., steel bars within the concrete structure. The impressed current is opposite and at least equal to the naturally occurring current which results under normal circumstances. The net result of impressing a direct current which is opposite and equal to the naturally occurring current is to prevent electrolytic corrosion action on the reinforcing steel bars.

Suitable valve metals include titanium, zirconium, niobium, tantalum, and alloys comprising one or more valve metals or metals having properties similar to those of valve metals. Titanium is a preferred valve metal as it is readily available and relatively inexpensive when compared with the other valve metals. Preferably, the titanium is ASTM 265 titanium grade 1 or 2.

It is well known that valve metals exposed to normal atmospheric conditions will inevitably possess a surface oxide layer for example, titanium oxide ($TiO_2$) which can be stoichiometric or non-stoichiometric depending upon the conditions of formation of the oxide layer. The valve metal strips forming the grid anode of the invention are believed to have a surface oxide layer which is stoichiometric as represented by the compounds $TiO_2$, TiO, and $Ti_2O_3$. Accelerated tests indicate that the lifetime of the electrode can be substantially extended by activating the electrode at elevated temperatures. It is considered that this process results in the formation of a surface oxide layer which is stoichiometric.

The novel grid electrode can be formed by electrically connecting intersecting valve metal strips. The grid anodes can be formed of a plurality of valve metal strips having trough and crest nodes or protrusions defining upper and lower planes at the extremities of said nodes as shown in FIGS. 8–13. The nodes of the valve metal strip can be spaced longitudinally to provide an intermediate plane separating the upper and lower nodes. The trough and crest nodes, in a preferred embodiment, alternate both laterally and longitudinally. The metal grid anodes of the invention are electrically connected at intersecting strip areas, such as by welding.

Other shaped valve metal strips can be used as shown in FIGS. 1–7. In addition, valve metal strips of the expanded valve metals shown in the prior art, such as those disclosed in U.S. Pat. No. 5,423,961 and non-porous valve metal strips can be used to form the grid electrodes of the invention.

The use of the valve metal grid anode without an electrocatalytically active metal surface in a cathodic protection system for reinforced steel elements in concrete is limited to those applications where the anode current density is controlled at up to about 20 milliamps per square foot unless the valve metal is activated by heating at an elevated temperature. Generally, the grid anodes of this embodiment of the invention can be prepared from a valve metal such as grade 1 or grade 2 titanium which normally has an oxide film on the surface thereof. Preferably, a valve metal such as titanium is activated prior to use as an anode so as to extend the lifetime of the anode and allow use of the anode at higher anode current densities. Activation can be accomplished by heating the valve metal anodes at elevated temperature as previously described. Preferably, activation is accomplished by exposure of the valve metal grid to a temperature of about 250° C. to about 750° C., preferably, for a period of about 3 minutes to about 5 hours. Upon activation a substantial improvement in anode grid lifetime occurs, as indicated by the time for passivation of the anode grid to occur at a given anode grid current density. Useful valve metals for forming the anode grid are selected from the group consisting of titanium, tantalum, zirconium, niobium, and alloys and mixtures thereof.

Anode grid current densities of up to about 20 milliamps per square foot can be used with the valve metal grid anode of the invention not coated with an electrocatalytically active metal coating. Preferably, cathodic protection systems in which steel reinforcing elements are embedded in concrete are, generally, operated at an anode grid current density of about 0.1 to about 15 milliamps per square foot, most preferably, an anode grid current density of about 2 to about 10 milliamps per square foot. As indicated above, an extension of the lifetime of the valve metal anode grid can be obtained by heating the anode. Upon heat activation of the valve metal anode grid, anode grid current densities of up to about 50 milliamps per square foot can be used, preferably, about 10 to about 20 milliamps per square foot.

II

Where the novel grid anode of the invention is formed of strips of a composite comprising a valve metal base and an electrocatalytically active metal coating thereon, cathodic protection systems can be operated at substantially higher current densities such as up to about 80 to about 120 amperes per square foot.

The application of an electrocatalytically active metal coating on the surface of a valve metal substrate can involve painting or spraying an aqueous or organic solvent solution of a soluble precursor compound on the surface of the valve metal. Application of the precursor catalyst compound can also be made by electrolytic and electroless plating and by thermal spraying. Thermal spraying is defined to include arc-spraying as well as plasma and flame spraying. The electrocatalytically active metal can also be applied by thermal spraying of a metal or metal composite. Subsequent to application of a precursor compound, the coating is heated to convert the precursor compound to the electrocatalytically active metal form such as the oxide. Thermally sprayed coatings may not require heating to convert the catalytic coating to the catalytically active metal form.

The physical form of the electrocatalytically active metal coated grid electrode is similar to that described above for the grid electrode not having an electrocatalytically active metal surface, i.e., valve metal strips having a plurality of trough and crest nodes, as shown in FIGS. 8–13; valve metal strips as shown in FIGS. 1–7; expanded metal strips as disclosed in the prior art and non-porous valve metal strips. Where higher current densities are used with the electrocatalytically active metal coated grid electrode, it will be recognized by one skilled in this art that a larger number of anode strips or thicker or wider anode strips will be used to form the grid electrode.

Typical catalyst precursor compounds used to apply liquid solution coatings and thermal spray coatings consist of platinum group metal compounds selected from the group consisting of metal compounds of platinum, palladium, ruthenium, rhodium, osmium, iridium, or mixtures or alloys thereof. Cobalt, nickel, and tin compounds can also be utilized as electrocatalytic precursor compounds. The precursor compounds are heated to convert these or a portion of these compounds to their oxides.

It is to be understood that the valve metal strips can be coated with a composite of a catalytic coating either before or after forming into porous strips or before or after being assembled in grid form. Usually before coating, the valve metal will be subjected to a cleaning operating, e.g., a degreasing operation, which can include cleaning plus etching, as is well known in the art of preparing a valve metal to receive an electrochemically active metal coating. The electrochemically active metal coating composite can be provided from a valve metal and a platinum group metal, oxides of electrocatalytically active metals, or it can be any of a number of active oxide coatings such as the platinum group metal oxides, the oxides of tin, nickel, manganese, or magnetite, ferrite, cobalt spinel, or other mixed metal oxide coatings, which have been developed for use as anode coatings in the industrial electrochemical industry for an oxygen evolution reaction. It is particularly preferred for extended life protection of concrete structures that the anode coating be a mixed metal oxide, which can comprise a solid solution of a valve metal oxide and a platinum group metal oxide.

For the extended life protection of concrete structures, the coating should be present in an amount of from about 0.05 to about 0.5 gram of platinum group metal per square meter of electrode strip. Less than about 0.05 gram of platinum group metal will provide an insufficient electrochemically active metal coating for preventing passivation of the valve metal substrate over extended time, or to economically function at a sufficiently low single electrode potential to promote selectivity of the anodic reaction. On the other hand, the presence of greater than about 0.5 gram of platinum group metal per square meter of the electrode strip can contribute an expense without commensurate improvement in anode lifetime. In this embodiment of the invention, the mixed metal oxide composite coating is highly catalytic for an oxygen evolution reaction. The platinum group metal or mixed metal oxides for the coating are such as have been generally described in one or more of U.S. Pat. Nos. 3,265,526, 3,632,498, 3,711,385 and 4,528,084. More particularly, such platinum group metals for forming the composite include platinum, palladium, rhodium, iridium and ruthenium or alloys with other metals and the valve metals for forming the composite include titanium, tantalum, zirconium, niobium, and alloys and mixtures thereof. Mixed metal oxides comprise at least one of the oxides of these platinum group metals in combination with at least one oxide of a valve metal or an oxide of a valve metal and another non-precious metal such as the oxides of tin, nickel, cobalt, and manganese.

The three-dimensional structure of the expanded valve metal strips shown in FIGS. 1–13 in use in a concrete structure allows the distribution of the electrical current in multiple planes in the concrete. To obtain this three-dimensional current distribution, both the anode grid structure and the electrical current must not be concentrated in one plane. With a three-dimensional structure, there is less likelihood of any subsequent delamination of the usual concrete overlay as a result of the anode presence in the concrete structure. With the prior art expanded mesh structures, for instance there is a greater tendency for the concrete overlay to separate from the underlying concrete.

The distribution of current from the surfaces of the anode to the steel rebar depends upon the proximity of the anode surfaces to the rebar. If the anode grid is placed between two mats of steel rebar, then the current will emanate, generally, from both sides of the anode strands, and particularly from the surfaces in the planes of the crest and trough nodes of the anode strips of FIGS. 8–13 or the planes defined at the upper or upper and lower louver surfaces of the anode strips of FIGS. 1–7. The amount of current emanating from these surfaces will tend to be greater than the amount of current emanating from the essentially flat expanded metal grid anodes of the prior art in which the current from the plane of the expanded mesh structure emanates equally from the crossing and connecting strands; that is, the current would tend to be more evenly distributed.

Figure 1:
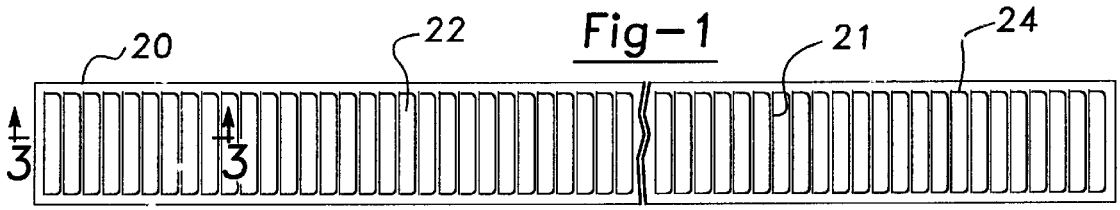
FIGS. 1–13 illustrate several examples of porous valve metal strips utilized to form the grid electrode of the invention shown in FIG. 14. Non-porous valve metal strips can also be used to form the grid electrodes of the invention. The porous valve metal strips are formed by slitting and subsequently expanding a valve metal strip in a direction normal or parallel to the largest dimension of the valve metal strip. Each of these valve metal strips can be formed into the grid electrode of the invention by electrically connecting the valve metal strips at the intersections of the strips. Alternatively, mixtures of the various examples of valve metal strips, including non-porous strips can be utilized to form the grid electrode of the invention.
Figure 4:
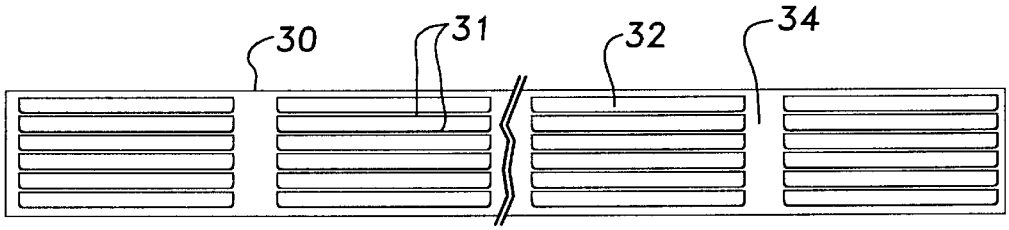
Figure 7:
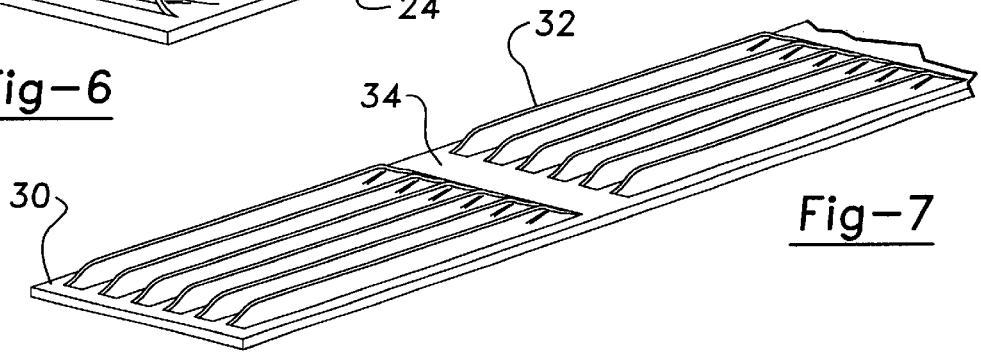

When the valve metal strips forming the grid electrode of the invention are characterized by a plurality of louvers, as shown in FIGS. 4, 5, and 7, arranged in multiple louver units and aligned in the long dimension substantially parallel in a longitudinal direction of the metal strip from which they are formed, each louver defines upper or upper and lower planes at the lateral extremities of said louvers. Multiple louver units are spaced from adjacent units by an intermediate plane. A series of multiple louver units aligned as indicated above have the same or alternating angles of about 20° to about 90° to said intermediate plane. In addition to the parallel or perpendicular alignment of the louvers in the long dimension in a longitudinal direction of the metal strip, as shown in FIGS. 4 and 1, respectively, the louvers can be oriented on the metal strip at any angle between 0 and 90° to the longitudinal direction of the metal strip.

When the valve metal strips forming the grid electrode of the invention are characterized by a plurality of substantially parallel louvers, as shown in FIGS. 1–3, and 6, and aligned in a lateral direction on said metal anode strip, each louver can define upper and lower planes at the extremities of said louvers. Said louvers are bordered at their lateral extremities by an intermediate plane. The strips are, generally, formed using an electrocatalytically active metal coated valve metal. The strips can also be coated with an electrocatalytically active metal after forming or after a grid structure bonded at the intersections of said metal strips is formed. Where the valve metal is coated with an electrocatalytically active metal layer, it is preferred that the coating comprise a mixed oxide of a platinum group metal and a valve metal or an additional platinum group metal, as set forth above.

In the example of a valve metal strip shown in FIG. 7, the valve metal strip is characterized by a plurality of louvers arranged in multiple louver units and aligned in the long dimension substantially parallel to the longitudinal direction of the metal strip. The louvers can define upper and lower planes at the lateral extremities of said louver units. The louver units are spaced from adjacent louver units by an intermediate plane. In another example shown in FIG. 6, the valve metal strip is a plurality of substantially parallel louvers aligned laterally in the long direction on the strip. The grid anode is formed with said strips, said louvers defining either upper or upper and lower planes at the lateral extremities of said louvers. Said louvers are bordered at their lateral extremities by an intermediate plane.

Figure 6:
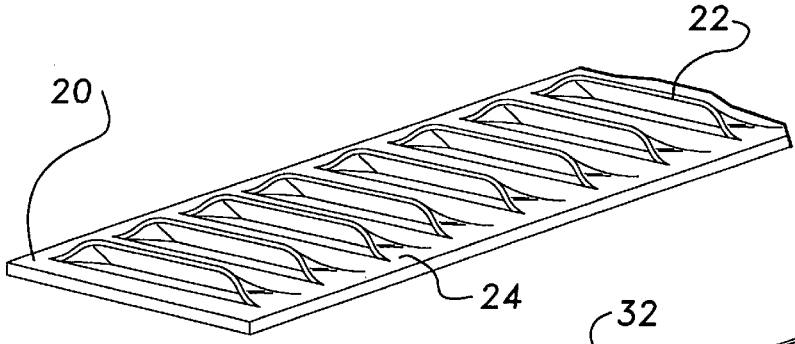

While each of the examples of valve metal strips described above in FIGS. 6 and 7 are useful, it is preferred to utilize the example shown in FIG. 7 so that electrical conductivity along the valve metal strip will not be compromised or at least reduced very little. Orienting the louvers of the valve metal strip laterally as in the example of FIG. 6 is less desirable with respect to electrical conductivity of the anode.

In another example not shown in the Figures, the multiple louver units define only an upper plane at their upper extremity; the lower extremity coinciding with the plane of the metal strip from which the anode is formed.

The openings formed by the louvers of these valve metal strips are large enough to allow a concrete grout to flow through such openings. Preferably, a minimum opening formed by the louvers is about 1/16 of an inch in dimension, more preferably, about 3/32 of an inch to about 1/8 of an inch. On the other hand, the louvers are not so large that, when they are formed by twisting the louver slats out of the plane of the starting strip of metal, they do not form a plane or planes which extend so as to be inadequately covered in use by the usual concrete overlay. Preferably, the anode grid profile when viewed from the side is less than about ½ inch.

The length of the louvers of the valve metal strips is less critical than the dimensions set forth above. Generally, the length of the louvers can be about ½ inch to more than 3 or 4 inches in the embodiment of FIG. 7 depending somewhat upon the width of the anode strip. Giving due consideration to the width and thickness of a particular louver slat, the length of the louver slat is not so great that the rigidity of the valve metal strips is compromised, that is, not so great that the valve metal strips would not retain the original orientation under normal handling or installation procedures. In addition, the length of the louver slat, if oriented along the length of the starting anode strip, as in the embodiment of FIG. 7, is not so great that upon rolling up the louvered anode, an inordinately large diameter roll would result. Most preferred dimensions of the anode are an anode strip having a width of about ¾ inch, about 0.020 inches in thickness having louvers about 1 to about 1 ½ inches long and about 3/32 of an inch to about 1/8 of an inch wide for the embodiments of FIG. 7.

The louvers of FIGS. 1–7 are formed by slitting a strip of valve metal, then twisting the slit strips into final orientation so as to form an angle with the base plane of the anode strip from which it is formed in which the angle of the louvers is at least about 20° C. to the plane of the original anode strip, preferably, at least about 70° to about 90° C. to said plane. The louvers can be oriented so that succeeding groups of louvers are turned in an alternate direction or the louvers can all be oriented in the same direction.

With respect to the example of the valve metal strip of FIG. 7, the louvers define either upper or upper and lower planes at the lateral extremities of said louvers. Intermediate between the upper and lower planes is the original base plane of the valve metal strip. The base or intermediate plane separating the series of louver groups can vary in longitudinal dimension but in order to maintain the ability of the valve metal to accommodate the penetration of concrete grout and to increase the effective valve metal surface area, the intermediate plane, generally, is not more than about 2 inches in longitudinal dimension, preferably, less than 1 inch in longitudinal dimension, and, most preferably, about ⅜ of inch to about ¼ of an inch in longitudinal dimension.

The anode grid strips can be formed using conventional metal working equipment such as a piercing die to perforate the metal strip in preselected portions and a die mechanism to impart the final shape to the louvers which can project both above or both above and below the base plane of the metal strip from which the grid anode is formed. In certain instances, the piercing and shape forming operations can be completed with the same dies.

Referring now to the drawings in greater detail, in FIG. 1, there is shown one embodiment of the valve metal strip in a plan view. Flat sheet stock valve metal strip 20 is slit laterally at 21 so as to define louvers 22 which are formed by twisting the slit sheet stock so as to form louvers which are inclined at an angle of at least 20° to the plane of the flat sheet stock valve metal. Bordering the longitudinal extremities of said louvers is plane 24 which is intermediate between the planes defined by the lateral extremities of louvers 22 which upon twisting extend both above and below the intermediate plane of the flat strip valve metal material.

Figure 3:
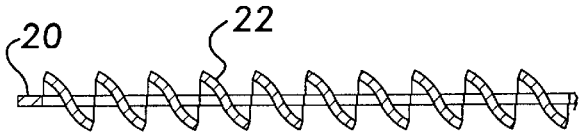

In FIG. 2, there is shown in a side view the valve metal strip having metal strip 20 and louvers 22 shown in a plan view in FIG. 1. An enlarged side view through section 3—3 is shown in FIG. 3 in which louvers 22 project both above and below the plane of metal strip 20.

In FIG. 4, there is shown in a plan view another embodiment of a valve metal strip used to form the grid anode of the invention in which a flat sheet stock valve metal strip 30 is slit longitudinally so as to allow louvers 32 to be formed by twisting sections defined by adjacent slits 31 in the flat sheet stock material. The louvers are raised by twisting the slit sheet stock to form a series of louver units oriented at an angle of at least 20° to the plane of the flat sheet stock material. Where the louvers project both above and below the surface of the metal strip from which they are formed, the louvers define at their lateral extremities upper and lower planes. The louvers can also project only above the surface of the metal strip from which they are formed. An intermediate plane 34 separates successive louver units.

In FIG. 5, there is shown in a side view the valve metal strip shown in a plan view in FIG. 4. It is noted that in each of these examples the louvers 32 are formed from flat sheet stock valve metal strip 34 without contracting or stretching the material longitudinally or laterally. Thus, the thickness as well as both longitudinal and lateral dimensions of the flat sheet stock valve metal strip remain essentially unchanged.

In FIGS. 6 and 7, there are shown isometric views of the valve metal strips shown, respectively, in plan view in FIGS. 1 and 4. In FIG. 6, flat sheet stock valve metal 20, louvers 22 and intermediate plane 24 are shown. In FIG. 7, flat sheet stock 30, louvers 32, and intermediate plane 34 are shown.

Figure 8:
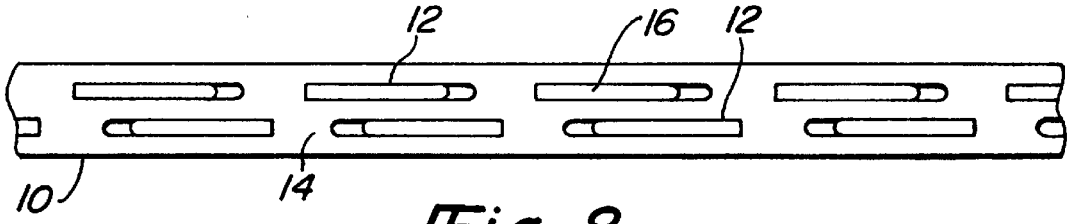

In FIG. 8, there is shown another embodiment of the valve metal strip used to form the grid anode of the invention in which flat sheet stock valve metal material 10 is slit at 12 so as to define nodes 16 which are raised or lowered in a direction normal to the plane of the flat sheet stock which is also defined as intermediate plane 14 in describing the geometry of the fabrication of the ribbon anode of the invention. Perforated portions shown as at 12 are produced by shearing preselected portions of flat sheet stock material 10 in closely spaced relation of one to another thereby forming exposed edges on each side. Slit areas 12 are pierced in sheet 10 by means of a piercing die, which is not shown, or by other known means and expanded to produce the finished configuration of the inventive structure. Slit areas 12 are symmetrically offset as laterally displaced rows which project slightly into longitudinally adjacent rows so as to provide an intermediate plane 14 as between slit areas 12. Nodes 16 are alternately raised and depressed to form, respectively, crest and trough nodes defining upper and lower planes at the extremities of said nodes. The nodes are formed from slotted areas by forcing these areas in a direction normal to the flat sheet stock intermediate plane while contracting or foreshortening the material longitudinally. The lateral dimensions of sheet stock material 10 remain unchanged during formation of the anode.

Figure 9:
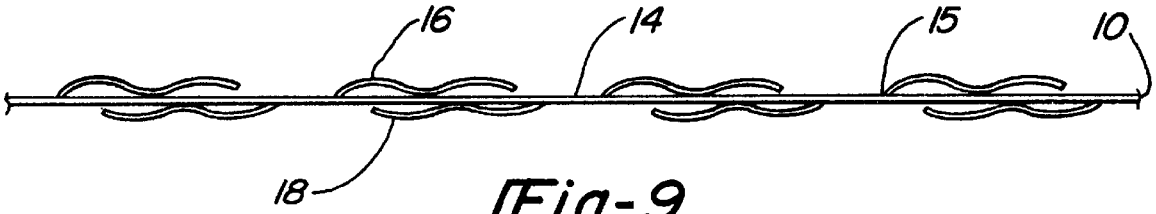

In FIG. 9, there is shown in a cross-sectional view the expanded nodes which are termed crests, upper node 16, and troughs, lower node 18, the expanded nodes 16 and 18 are longitudinally separated by intermediate planes 14 and are symmetrically staggered or offset and laterally displaced row on row and column on column with one node end attached to sheet stock material 10 at 15.

Figure 10:
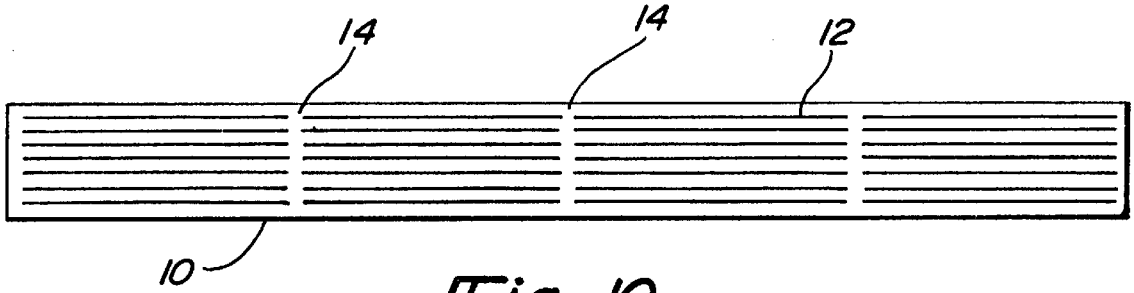

In FIG. 10, there is shown another embodiment of the valve metal strip used to form the grid anode of the invention. The strip is formed by first perforating valve metal sheet stock 10 to provide a plurality of longitudinally aligned slit areas 12 separated by an intermediate area 14.

Figure 11:
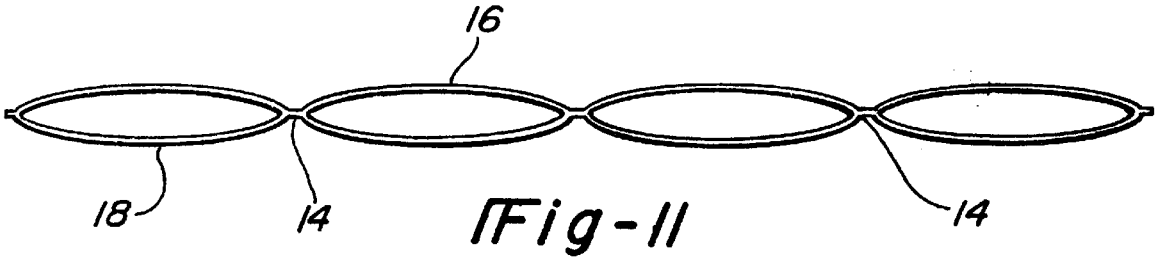

In FIG. 11, which is a cross-sectional view of the expanded ribbon anode shown in FIG. 10, upper node 16 and lower node 18 alternate both longitudinally and laterally and are separated by intermediate area 14.

Figure 12:
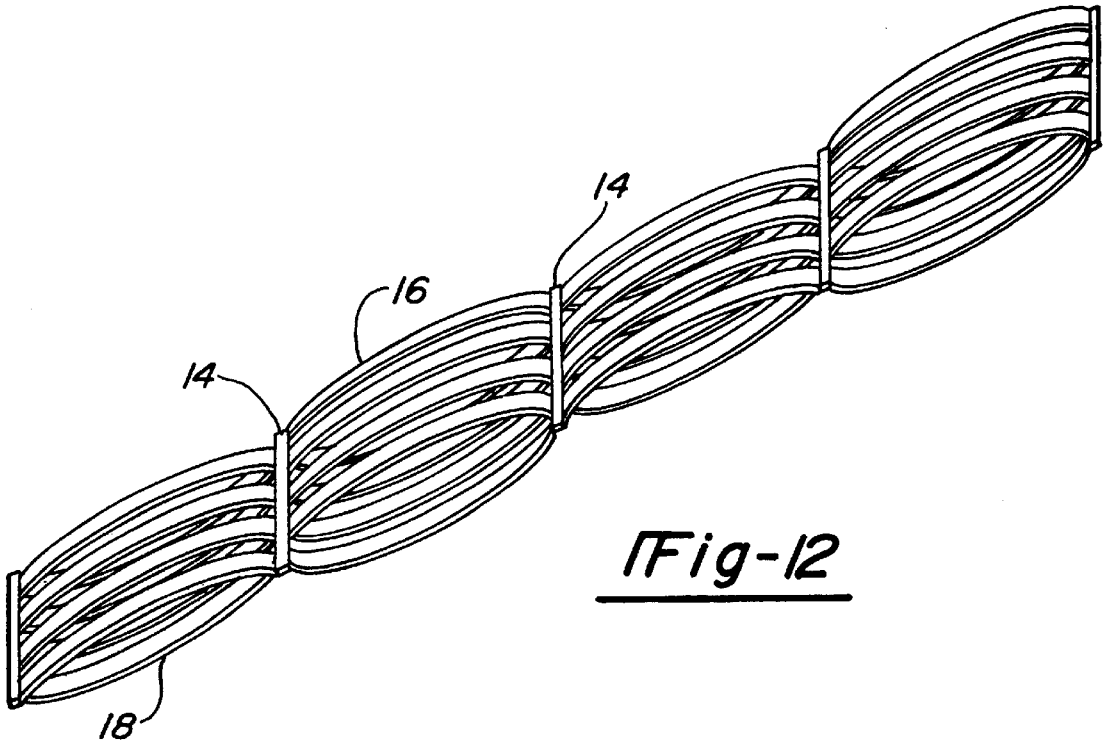

In FIG. 12, there is shown in an isometric view the embodiment of the valve metal strip shown in FIG. 11. Alternating trough node 18 and crest node 16 are separated by intermediate area 14.

Figure 13:
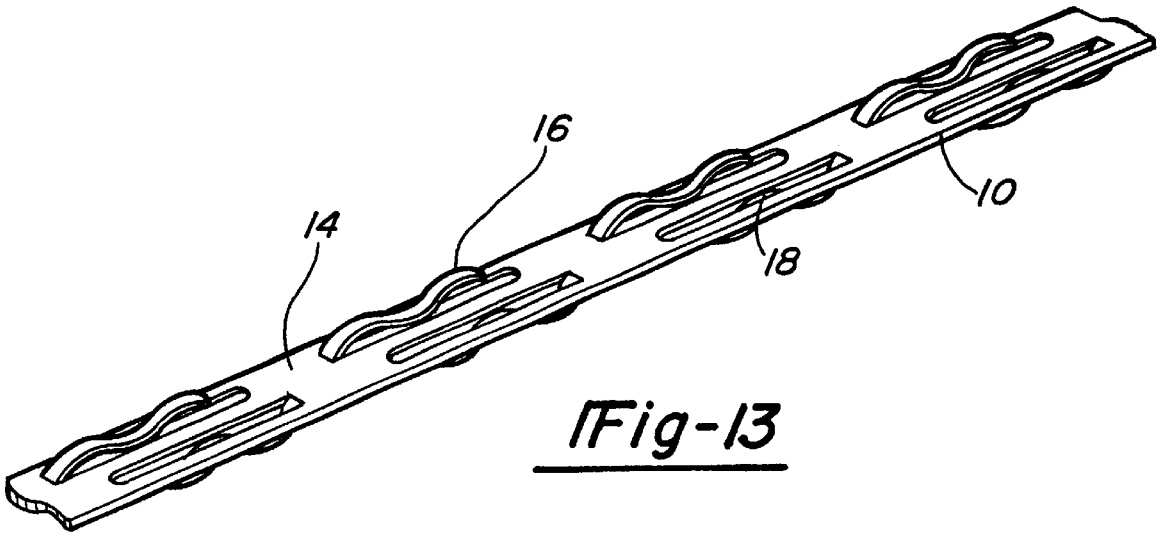

In FIG. 13, there is shown in an isometric view the embodiment of the valve metal strip shown in FIG. 9. The valve metal strip is formed from metal sheet stock 10. Between upper node 16 and lower node 18 is intermediate area 14 which separates the successive crest node 16 and trough node 18.

Figure 14:
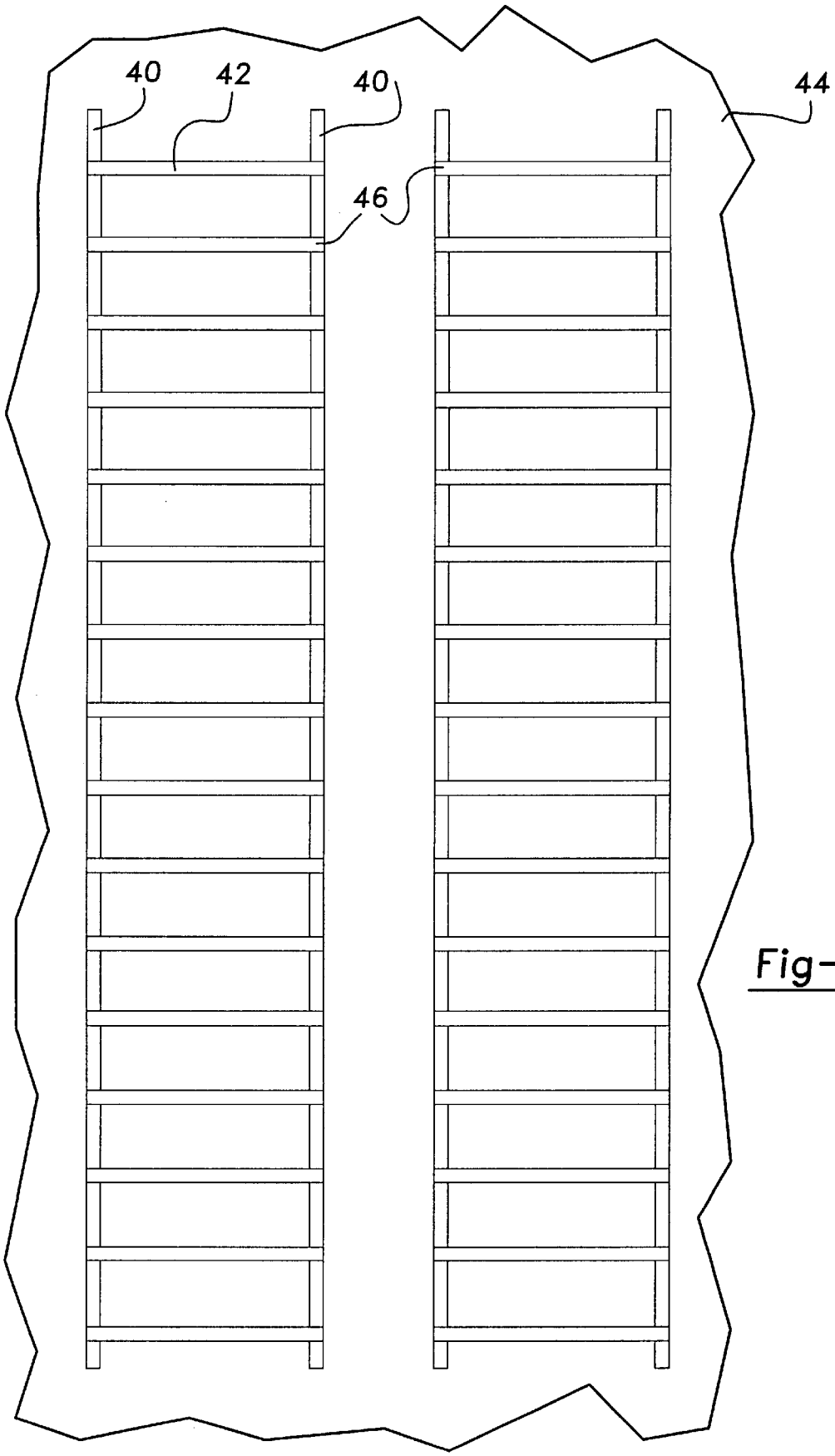
FIG. 14 is a diagrammatic representation of two grid anodes placed upon a concrete surface. Strips forming the grid can be either porous or non-porous, electrocatalytically coated valve metal or non-coated valve metal.

In FIG. 14, there is diagrammatically shown two individual grid anodes of the invention placed upon a concrete surface 44. Longitudinally extending members 40 and laterally extending members 42 are electrically connected at intersecting areas 46 which are termed nodes. Current distribution members not shown can be placed at intervals laterally across the grid anode to connect individual anode grids.

Each current distribution member is preferably a strip of valve metal either uncoated or coated with the same or different electrocatalytically active metal coating as the valve metal anode grid strips and is electrically connected to the valve metal strips of the grid electrode. In many installations such as parking garage decks and bridge decks, the current distributor strips can be advantageously bonded to the valve metal strips of the individual grid electrodes with a spacing of between 10 to 50 meters, such spacing calculated to provide an adequate current density to the grid electrode. In such installations, it is also accost saving and convenient to have a common current distributor strip bonded to and extending across at least two individual longitudinally oriented grid strips, for example across two elongated sheets of the grid electrodes which have been rolled out side-by-side from two rolls of grid electrode.

When the protected structure is a concrete deck covered by a series of side-by-side elongated sheets of the grid with a common current distributor strip extending across the grids, the current distributor strip may conveniently extend through an aperture in the deck to a current supply disposed underneath the deck at a location where it is readily accessible for servicing etc.

The protected structure can be, for instance, a cylindrical pillar having the grid electrode covered by an ion-conductive overlay. The current distributor can in this case be a strip disposed vertically on the pillar and the grid is cut to size so that it is wrapped around the pillar with little or no overlap.

The invention also pertains to a method of cathodically protecting steel pipelines placed in sea water, saline muds, or in the ground by supplying a continuous or intermittent current to a valve metal grid electrode placed in association therewith at a current density of up to about 120 amps per square foot. This current is effective for oxygen generation on the surfaces of the coated valve metal grid and can be established by taking periodic measurements of the corrosion potential of the steel pipeline using suitably distributed reference electrodes in the proximity of the steel pipeline, and setting the operative current density to maintain the steel at a desired potential for preventing corrosion.

While this invention has been described with reference to certain specific embodiments, it will be recognized by those skilled in the art that many variations are possible without departing from the scope and spirit of the invention and it will be understood that it is intended to cover all changes and modifications of the invention disclosed herein for the purposes of illustration which do not constitute departures from the spirit and scope of the invention.

What is claimed is:

1. A grid electrode for cathodic protection in a steel reinforced concrete structure comprising a plurality of valve metal strips spaced apart, said strips forming nodes at the intersections of said strips, said nodes being present in the amount of less than 100 nodes per square meter, said strips being electrically connected at the intersections thereof to form a grid, and said grid electrode further comprising a plurality of electric current-carrying metal members consisting of a valve metal spaced apart and extending across at least two valve metal strips.

2. The grid electrode of claim 1 wherein said valve metal strips are formed by slitting and expanding said valve metal strips in a direction of the plane of a largest surface area of said strips or slitting and elongating a portion of said valve metal strips at an angle of at least about 20° to the plane of the largest surface of said valve metal strips.

3. The grid electrode of claim 2 wherein said valve metal strips comprise an electrocatalytically active metal surface formed of a composite comprising a valve metal or oxide thereof and a platinum group metal or oxide thereof or a valve metal or oxide thereof and an oxide of an electrocatalytically active metal for an oxygen evolution reaction and said valve metal strips are connected by welding.

4. The grid electrode of claim 3 wherein said valve metal of said composite is selected from the group consisting of titanium, tantalum, zirconium, niobium, and alloys and mixtures thereof and said oxide of an electrocatalytically active metal is selected from the group consisting of the oxides of tin, nickel, cobalt, and manganese.

5. The grid electrode of claim 4 wherein said valve metal is selected from the group consisting of titanium and tantalum.

6. The grid electrode of claim 4 wherein said valve metal of said composite comprises titanium.

7. The grid electrode of claim 2 wherein said valve metal is selected from the group consisting of titanium and tantalum.

8. A concrete structure comprising a cathodic protection grid electrode in steel reinforced concrete, said electrode comprising a plurality of valve metal strips, said strips forming nodes at the intersections of said strips, said nodes being present in the amount of less than 100 nodes per square meter, and said strips being electrically connected at said intersections to form a grid, and said grid electrode further comprising a plurality of electric current-carrying metal members consisting of a valve metal spaced apart and extending across at least two valve metal strips of said grid electrode.

9. The concrete structure of claim 8 wherein said valve metal strips are formed by slitting and expanding said strips in a direction of a plane of a largest surface of said valve metal strips or slitting and expanding a portion of said strips in a direction normal to said largest surface of said valve metal strips.

10. The concrete structure of claim 9 wherein said valve metal strips comprise an electrocatalytically active metal surface formed of a composite comprising a valve metal or oxide thereof and a platinum group metal or oxide thereof or a valve metal or oxide thereof and an oxide of an electrocatalytically active metal for an oxygen evolution reaction and said valve metal strips are connected by welding.

11. The concrete structure of claim 10 wherein said valve metal of said composite is selected from the group consisting of titanium, tantalum, zirconium, niobium, and alloys and mixtures thereof and said oxide of an electrocatalytically active metal is selected from the group consisting of the oxides of tin, nickel, cobalt, and manganese.

12. The concrete structure of claim 11 wherein said valve metal of said composite is tantalum or titanium.

13. A grid electrode for cathodic protection of a steel reinforced concrete structure comprising a plurality of spaced apart metal strips consisting of a valve metal, said strips forming nodes at the intersections of said strips, said nodes being present in the amount of less than 100 nodes per square meter, said strips being electrically connected at the intersections thereof to form a grid, and said grid electrode further comprising a plurality of electric current-carrying spaced apart metal members consisting of a valve metal, extending across and electrically connected to at least two valve metal strips.

14. The grid electrode of claim 13 wherein said valve metal strips are formed by slitting and expanding said valve metal strips in a direction of a plane of a largest surface area of said valve metal strips or slitting and elongating a portion of said valve metal strips at an angle of at least about 20° to the plane of the largest surface area of said valve metal strips.

15. The grid electrode of claim 14 wherein said valve metal strips are connected by welding.

16. The grid electrode of claim 15 wherein said valve metal is selected from the group consisting of titanium, tantalum, zirconium, niobium, and mixtures thereof.

17. The grid electrode of claim 16 wherein said valve metal consists of titanium.

18. The grid electrode of claim 14 wherein valve metal is selected from the group consisting of titanium and tantalum.

19. A concrete structure comprising steel reinforced concrete and a cathodic protection grid electrode comprising a plurality of spaced apart metal strips consisting of a valve metal, said strips forming nodes at the intersections of said strips, said nodes being present in the amount of less than 100 nodes per square meter, and said strips being electrically connected at said intersections thereof to form a grid, and said grid electrode further comprising a plurality of electric current-carrying spaced apart metal members consisting of a valve metal extending across and electrically connected to at least two valve metal strips of said grid electrode.

20. The concrete structure of claim 19 wherein said valve metal strips are formed by slitting and expanding said strips in a direction of a plane of a largest surface area of said valve metal strips or slitting and expanding a portion of said valve metal strips in a direction normal to said largest surface area of said valve metal strips.

21. The concrete structure of claim 20 wherein said valve metal strips are connected by welding.

22. The concrete structure of claim 21 wherein said valve metal is selected from the group consisting of titanium, tantalum, zirconium, niobium, and mixtures thereof.

23. The concrete structure of claim 22 wherein said valve metal is selected from the group consisting of tantalum and titanium.

* * * * *